US006071096A

United States Patent [19]

Grasl

[11] Patent Number: 6,071,096

[45] Date of Patent: Jun. 6, 2000

[54] PNEUMATIC CYLINDER, IN PARTICULAR FOR ACTUATING FUME EXTRACTION VALVES IN FUME AND HEAT EXTRACTION PLANTS

[76] Inventor: Andreas Grasl, Wiener Strasse 23, A-3452 Heiligeneich, Austria

[21] Appl. No.: 09/171,841

[22] PCT Filed: Apr. 25, 1997

[86] PCT No.: PCT/EP97/02140

§ 371 Date: Oct. 27, 1998

§ 102(e) Date: Oct. 27, 1998

[87] PCT Pub. No.: WO97/41357

PCT Pub. Date: Nov. 6, 1997

[51] Int. Cl.[7] ..... F04B 53/10

[52] U.S. Cl. ..... 417/534; 417/531; 417/491; 417/523; 417/521; 417/556; 91/399; 91/396; 91/410; 91/443; 91/170 R; 92/24; 123/532; 123/46; 205/392

[58] Field of Search ..... 417/531, 534, 417/491, 523, 521, 556; 91/396, 399, 51, 519, 410, 443, 170 R; 92/24; 454/49, 369; 251/299; 123/532, 46; 205/392

[56] References Cited

U.S. PATENT DOCUMENTS

| | | | |
|---|---|---|---|
| 3,576,151 | 4/1971 | Sendoykas | 92/24 |
| 3,645,170 | 2/1972 | Varouxis | 91/399 |
| 3,694,111 | 9/1972 | Braun | 417/491 |
| 3,759,142 | 9/1973 | Maytag | 91/396 |
| 3,834,276 | 9/1974 | Gournelle | 91/51 |
| 3,850,086 | 11/1974 | Walters et al. | 454/49 |
| 3,912,223 | 10/1975 | Iwata | 251/299 |
| 3,999,463 | 12/1976 | Greenwood | 91/395 |
| 4,233,885 | 11/1980 | Deschner | 90/410 |
| 4,471,806 | 9/1984 | Strock | 137/614.2 |
| 4,738,189 | 4/1988 | White et al. | 454/369 |
| 4,930,403 | 6/1990 | Hested | 91/443 |
| 4,944,277 | 7/1990 | Olson | 123/532 |
| 5,090,296 | 2/1992 | Todd . | |
| 5,275,085 | 1/1994 | Hur | 91/170 R |
| 5,533,435 | 7/1996 | Kita | 91/519 |
| 5,759,018 | 6/1998 | Transcheidt | 417/531 |
| 5,914,023 | 6/1999 | Roy et al. | 205/392 |

FOREIGN PATENT DOCUMENTS

| | | |
|---|---|---|
| 0363575B1 | 9/1994 | European Pat. Off. . |
| 1962246A | 6/1971 | Germany . |
| 3030104A | 3/1982 | Germany . |
| 8223710 U | 10/1982 | Germany . |
| 89/08785 | 9/1989 | WIPO . |

*Primary Examiner*—Teresa Walberg
*Assistant Examiner*—Leonid Fastovsky
*Attorney, Agent, or Firm*—Baker Botts, LLP

[57] ABSTRACT

A pneumatic cylinder for actuating fume extraction valves in fume and heat extraction plants has a piston (2) that may be actuated from both sides with at least one working surface and that can be made to slide by pressurised air in a cylinder (1) with at least one working chamber (4), as well as an energy accumulator with regulating means. The regulating means can be controlled by control means to open or keep open the fume extraction valves. In order to obtain a compact pneumatic cylinder for a fume and heat extraction plant which is easy to install, a storage chamber in which air or pressurised air is stored as compressible pressure medium is provided as energy accumulator. The storage chamber is in communication with a compression surface (7) of the piston (2), at its side opposite to the working surface (7), so that pressure medium may flow between the storage chamber and the compression surface (7). The controller actuates a venting valve in communication with the working chamber (4) so that pressurised air may flow between the venting valve and the working chamber (4).

15 Claims, 9 Drawing Sheets

PNEUMATIC CYLINDER, IN PARTICULAR FOR ACTUATING FUME EXTRACTION VALVES IN FUME AND HEAT EXTRACTION PLANTS

The invention relates to a pneumatic cylinder for actuating an adjustable element, especially a smoke exhaust damper in a smoke and heat exhaust system according to the preamble of claim 1.

Compressed-air tanks with a piston to which pressure can be admitted on both sides and having at least one working face which can be displaced by compressed air in a cylinder having at least one working chamber are used, for example, in smoke and heat exhaust systems (abbreviated: SHE systems) in order to open smoke and heat exhaust dampers automatically or by remote control by admission of compressed air to a cylinder space or cylinder chamber in the event of fire, so that produced smoke which would otherwise make rescue difficult or impossible can be exhausted and so that a central access for rescue is created. Opening of the heat and smoke exhaust dampers is also intended to prevent the development of heat buildup. The pneumatic cylinder used must meet stringent safety requirements. In this connection, it is also known how to provide pneumatic cylinders with end-position interlocks, which among other purposes are intended to ensure extensive safety against collapse. A specially advantageous end-position interlock, which is also suitable for immobilizing a piston rod of the pneumatic cylinder in intermediate position, is characterized in that an additional latching rod coaxial with the piston rod and displaceable theretoward up to a stop on the piston rod is provided, said latching rod limiting the piston rod to a partial stroke and in this partial-stroke position protruding into a latching cylinder disposed on a latching piston (EP 0363575 B1). In the latching cylinder there is displaceably provided an additional latching piston which embraces balls with a sleeve-like section in partial-stroke position, said balls engaging in an annular groove in the additional latching rod and otherwise being radially movable. The radially outwardly movable balls are released when the sleeve-like section is axially retracted. When a predetermined pressure is exceeded, the additional latching piston is brought into communication with the closest adjacent cylinder space via a pressure-controlled changeover valve. This immobilization of an intermediate position is combined with interlocking elements of the end-position interlocks in the form of balls, which are held by spring-loaded latching pistons in grooves of the piston rod.

Among the aforesaid safety requirements of the pneumatic cylinders being used, it is necessary that they open the smoke exhaust dampers coupled therewith in practically failsafe manner in the event of fire and hold them in open position, for which purpose one of the said end-position interlocks can be used. In order that opening of the smoke exhaust damper takes place reliably even in the event of fire, the pressure-conducting medium for SHE cylinders actuated by pressurized fluid is supplied via fire-protected lines. However, the use and assembly of fire-protected lines represents a considerable extra expense.

Another known option for fire-protected design of an SHE system constructed with an SHE cylinder comprises equipping the SHE cylinder with a gas-filled compression spring. This gas-filled compression spring, however, is sometimes not adequately reliable—not to mention the expense incurred therefor.

Furthermore, it is known that the SHE cylinder can be combined with a mechanical spring which stores sufficient spring energy that a smoke exhaust damper can be swiveled to its open position together with the movable parts of the SHE cylinder in the event of fire. Because of this additional spring, however, the SHE cylinder equipped therewith is voluminous and in particular is unmanageably long.

The object of the present invention is therefore to provide the most compact possible pneumatic cylinder of the type mentioned in the introduction, especially as an SHE cylinder, which operates successfully without additional (types of) auxiliary energy and without additional external lines, especially of fire-protected type, and which can be installed without complication, especially in SHE systems.

This object is achieved by the design of a pneumatic cylinder of the type mentioned in the introduction with the features specified in the body of claim 1.

This pneumatic cylinder operates successfully without additional type of auxiliary energy, since it is controlled only by the compressible pressurizing fluid used for normal operation thereof, especially compressed air. During normal actuation of this pneumatic cylinder for positioning an adjustable element, especially for closing a smoke exhaust damper, air enclosed in the accumulator chamber of the pneumatic cylinder is itself compressed, thus developing an air-filled spring in combination with the piston. To position the adjustable element in opposed directions, especially to open a smoke exhaust damper, especially in the event of fire, it is merely necessary for the pressure prevailing on the working side of the piston to be relieved by venting the working chamber, allowing the piston to be displaced under the action of the compressed air in the accumulator chamber. This operating principle therefore requires that the accumulator chamber, which adjoins the compression side of the piston facing away from the working surface, be sufficiently prefilled with air in order that the piston, in response to pressure on its working face, can adequately compress the compressible air in the accumulator chamber. The pressure built up in the accumulator chamber depends on the ratio of the areas of the working face and compression face of the piston, the working face in particular being smaller, and also on the stroke of the piston or its displacement volume during its movement from a first to a second end position. This function requires that, if at all possible, no air loss occur in the accumulator chamber, in any case under constant ambient conditions (temperature), especially during the subsequent stroke movements.

In the case in which the pneumatic cylinder is used in an SHE system, in which the smoke damper swivels under the influence of gravity beyond a predetermined opening angle, usually 90°, and continues to a larger opening angle of 140°, for example, and thus forcibly pulls the piston rod of the pneumatic cylinder along via the usual mechanical connecting elements, air is sucked back into the accumulator chamber, whereby a prior loss of pressurizing fluid can be compensated for at least partly. A suitable structural expedient for using this suction effect selectively in the last-mentioned special SHE systems with large opening angles is specified in claim 11.

Accordingly, the pressurizing-fluid refilling device, especially for the said special SHE systems, provides in structurally simple manner that it is designed as a pressurizing-fluid suction device in the form of an underpressure valve, preferably in a cylinder bottom or a cylinder wall, via which the cylinder space partitioned off from the working chamber is in communication with the outside atmosphere. Via this underpressure valve, the air content of the accumulator chamber can be maintained selectively by sucking in air from the outside atmosphere by using the normal function of the pneumatic cylinder. Moreover, a compact construction is achievable with this design of the pneumatic cylinder.

Alternatively, to achieve the pressure refilling device according to claim 7, the working chamber and the cylinder space partitioned off therefrom can be brought into communication via a flow path in which there is disposed a differential-pressure limiter automatically controlled by mechanical means. In this case, when the piston is in a position, preferably predetermined by a stop, of maximum compression of the compressed air contained in the accumulator chamber, the path to the working chamber is opened when the pressure difference between working chamber and accumulator chamber exceeds a value preset on the differential-pressure limiter. At the same time partial pressure equalization takes place, wherewith the accumulator chamber is automatically filled to make up for the pressurizing fluid lost due to possible leakage.

The particulars of this variant of the pressure-refilling device are disclosed in advantageously compact manner in the piston according to claim 8: In the piston there are disposed in the piston a first valve slide as well as a nonreturn valve, which acts as a differential-pressure limiter in such a way that a flow path between the working chamber and the cylinder space partitioned off therefrom can be opened in the piston. For this purpose the first valve slide can be actuated by a push rod disposed in the cylinder space, which forms the accumulator chamber. The flow path in the piston is opened when the first valve slide, especially the push rod thereof, encounters together with the piston the stop or a corresponding fixed surface, and a pressure difference between the working chamber and the cylinder space exceeds a value preset on the nonreturn valve.

A preferred variant of the pneumatic cylinder has the features that the nonreturn valve is constructed as a second valve slide and that the second valve slide as well as the first valve slide, together with a push rod extending therefrom, are mounted coaxially one after the other in a common bore in the piston, in one end of which there is positioned an insert, and that the first valve slide and the second valve slide are thrust outward toward sealing surfaces by a compression spring disposed between them. This variant can be made under conditions favorable to fabrication with only a few parts, especially for the design of the piston with only one bore for both valve slides.

Particularly good seals with maximum accumulation capability are achieved when the first valve slide and the second valve slide have the form of rubber moldings with sealing bead formed annularly on their external end face.

The function of the first valve slide disposed in the piston requires that a stop or a corresponding fixed surface limit the piston movement. This stop or surface is disposed in the cylinder space partitioned off from the working chamber, wherein this cylinder space forms either the accumulator chamber completely, as in claim 2, or can represent part of this accumulator chamber, as in claim 3.

The first case according to claim 2, in which the accumulator chamber is formed completely by a substantially closed cylinder space, which in the cylinder is partitioned off from the working chamber by the piston, corresponds to an extremely uncomplicated construction of relatively narrow diameter.

In the design according to claim 3, in which a partial accumulator chamber is in communication via a flow path with the cylinder space, which if need be forms part of the accumulator chamber, the partial accumulator chamber can be of very spacious design. Advantageously the partial accumulator chamber is an annular chamber disposed around the cylinder. This permits a relatively short construction of the cylinder, which nevertheless has a relatively large outside circumference. It may also be advantageous to separate the partial accumulator chamber structurally from the cylinder or the cylinder unit, so that it comprises an external accumulator chamber.

According to claim 5, the displaceability of the piston is generally limited by a stop in the cylinder chamber, which is partitioned off from the working space and forms an accumulator chamber or part thereof. In this case the stop can also be disposed outside the cylinder space and, for example, can engage on a piston rod. By means of the stop, the end pressure in the accumulator chamber is partly determined by compression of the compressible pressurizing fluid, which in this case is air or compressed air. The value of the end pressure is chosen to be sufficiently high that the force-travel curve of the pneumatic cylinder always lies above the load curve defined by actuation of the smoke exhaust damper.

Furthermore, according to claim 12, the cylinder space partitioned off from the working chamber is preferably in communication with the outside atmosphere via an overpressure-limiting valve, which is preferably disposed in a cylinder bottom or a cylinder wall. Therewith it is achieved that, even during a rise of the ambient temperature, the end pressure in the accumulator chamber does not exceed a predetermined value, in order to ensure normal functioning of the pneumatic cylinder and to prevent excessive stresses and strains on the heat exhaust damper and the connecting elements associated therewith.

As mentioned, the pneumatic cylinder according to claim 13 can be advantageously equipped with an end-position interlock engaging on the piston rod, by means of which the piston can be interlocked at least in the one end position with the working chamber vented, in order to hold the smoke exhaust damper open. In a further embodiment according to claim 14, a two-sided end-position interlock of the piston rod is provided.

In claim 15 it is emphasized that the accumulator chamber is prefilled with air, which can also be branched off from the compressed air for actuation of the pneumatic cylinder.

Six variants of the pneumatic cylinder according to the invention with inventive features are described hereinbelow with reference to a drawing comprising thirteen figures, wherein each variant is illustrated in a longitudinal section and:

Figure 1:
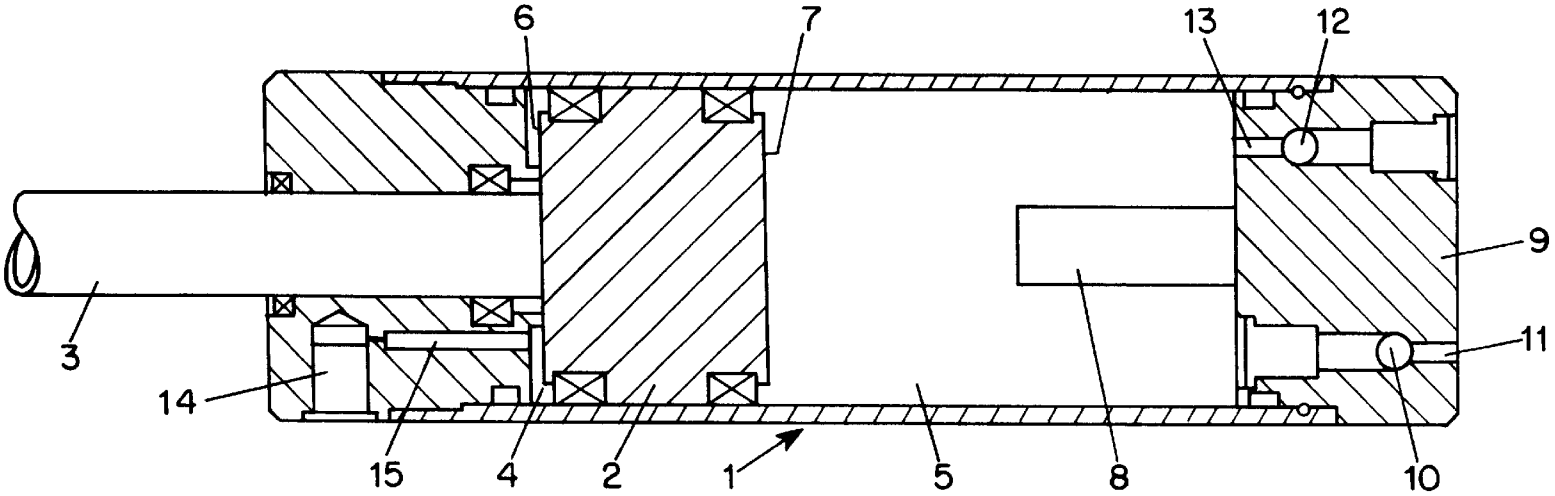
FIG. 1 shows a first variant with a pressurizing-fluid suck-back device and an overpressure-limiting valve in an opened position of the smoke exhaust damper (not illustrated), connected to a piston rod.

In FIG. 1, a pneumatic cylinder represented as a whole by 1 is provided with a piston 2, which can admit pressure on both sides and which has a piston rod 3. The piston 2 separates a working chamber 4 from a cylinder chamber 5, which is formed as an accumulator chamber for storing air or compressed air as the compressible pressurizing fluid. In cylinder chamber 5 there is mounted at the center a stop 8 on a cylinder bottom 9.

An underpressure valve 10 is sunk into the cylinder bottom, and more specifically in a flow passage 11, which allows the cylinder space 5 to communicate with an outside atmosphere (not shown). The underpressure valve comprises specifically a spring-loaded ball, which is urged inward toward the cylinder space by the outside atmospheric pressure and in this way opens the flow passage 11 when the pressure in the cylinder space is below the outside pressure by a predetermined value in the piston position illustrated in FIG. 1. In this case air is refilled into the cylinder space under atmospheric pressure.

Figure 2:
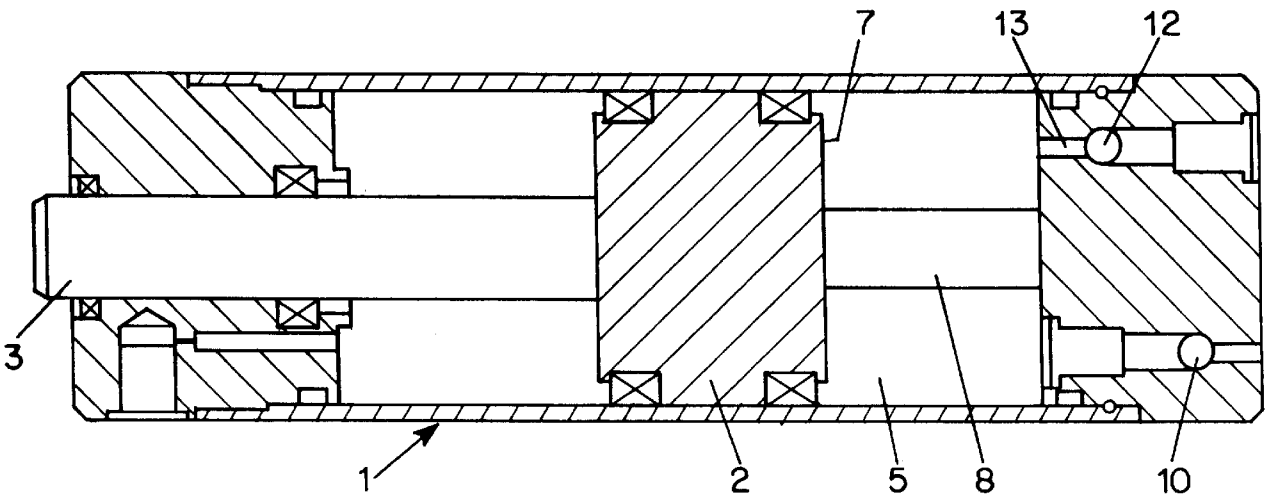
FIG. 2 shows the first variant in a position which corresponds to a closed position of the smoke exhaust damper.

The overpressure-limiting valve 12, which is also sunk into the cylinder bottom, is of design similar to that of the described underpressure valve 10, but is oriented in the opposite direction in a flow passage 13 in such a way that it opens this passage to the outside atmosphere when the piston 2 is in the position shown in FIG. 2 and then an overpressure which exceeds a preset value of the overpressure-limiting valve 12 prevails in the cylinder space 5.

The basic function of the pneumatic cylinder 1 illustrated in FIGS. 1 and 2 is as follows, with the assumption once again that the piston rod 3 is connected via connecting elements (not illustrated) with a swiveling smoke exhaust damper in an SHE system.

To move the exhaust damper, which in the position of piston 2 and of piston rod 3 according to FIG. 1 is open, to a closed position, the working chamber 4 is supplied by means (not illustrated), especially controlled valves, with compressed air via a connecting bore 14 and a flow passage 15. Via a working face 6 of the piston, the compressed air acts thereon to displace it to the right in FIG. 1, since in the illustrated starting position a low pressure prevails in the cylinder space 5, which represents the largely closed accumulator chamber. During displacement of the piston toward the cylinder space 5, the air prefilled therein is compressed by the compression face 7 of the piston, which at that time is moving toward the cylinder bottom 9. As a result, there is generated in the cylinder space 5 an overpressure which is lower than the pressure of the compressed air in working chamber 4, but corresponds to the ratio of the areas of working face 6 and compression face 7 and to the piston displacement volume, which the piston 2 displaces in the cylinder space 5 when it is moved from the end position illustrated in FIG. 1 to the end position shown in FIG. 2 under the effect of the pressure of the compressed air in working chamber 4.

When the pressure of the air compressed in this way in the cylinder space exceeds a predetermined value, especially during subsequent rise of the ambient temperature, the overpressure-limiting valve 12 opens.

In the end position shown in FIG. 2, the piston 5 is therefore preloaded under the pressure of the compressible air in the cylinder space 5, which represents the accumulator space.

If the smoke exhaust damper (not illustrated) must be opened, for example in the event of fire, it is not necessary to supply further energy to the pneumatic cylinder, but instead it is sufficient to vent the working space through a valve arrangement (not illustrated), which is connected to the connection bore 5, and which can be, for example, a solenoid valve or three/two-way valves. In this case, therefore, the pressure in working chamber 4 is practically equal to the pressure of the outside atmosphere, so that the piston 2, under the pressure of the precompressed air in cylinder chamber 5, can retract from the end position illustrated in FIG. 2 back to the end position shown in FIG. 1 and can open the smoke exhaust damper. If a predetermined opening angle such as 90° is exceeded in the case of overturning smoke exhaust dampers, the damper drops automatically to its opened end position, which may be 140°, for example, and pulls the piston rod 3 and piston 2 along with it, whereby the pressure in the cylinder space 5 can drop below the pressure of the outside atmosphere, although the cylinder space 5 would then no longer be sufficiently prefilled for the next compression phase during closing of the smoke exhaust damper. To avoid this situation, the underpressure valve 10 opens as described, until the desired degree of filling has been achieved.

Figure 3:
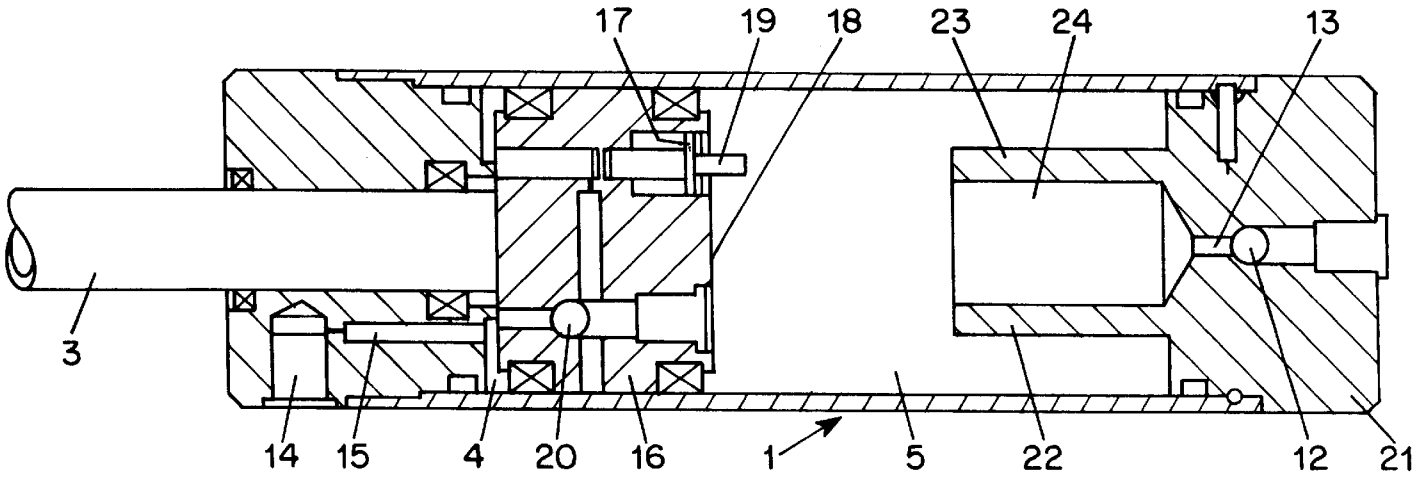
FIG. 3 shows a second variant with a pressurizing-fluid refilling device and an overpressure-limiting valve in a position corresponding to an opened position of the smoke exhaust damper (not illustrated)
Figure 4:
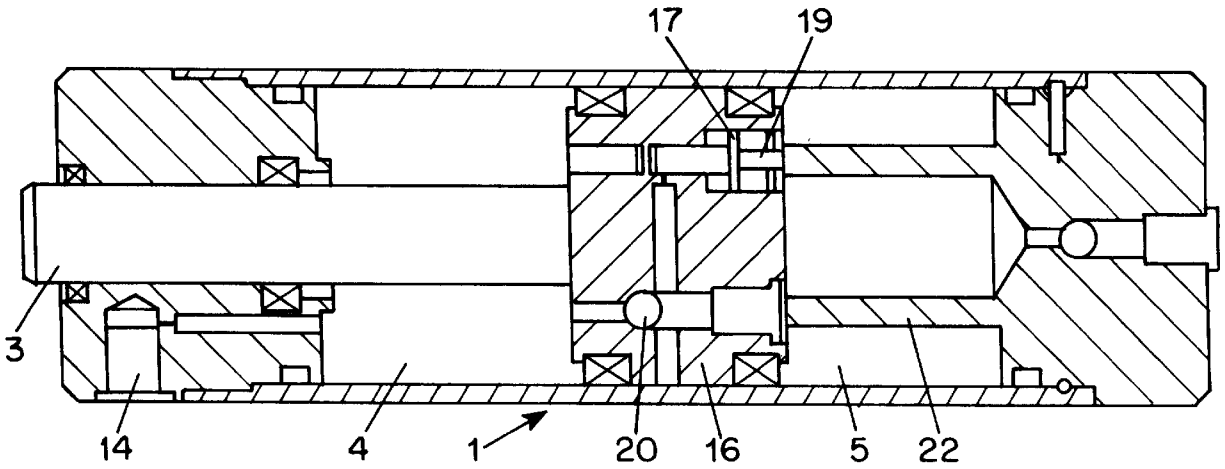
FIG. 4 shows the second variant in a position which corresponds to the closed position of the smoke exhaust damper.

The second variant shown in FIGS. 3 and 4 differs from the discussed first variant by the fact that a pressurizing-fluid refilling device is disposed in the piston 16 instead of the underpressure valve 10 in the cylinder bottom. Otherwise like elements have like reference numbers in all variants of the pneumatic cylinder. Specifically, the pressurizing-fluid refilling device in piston 16 substantially comprises a first valve slide 17 with a push rod 19 projecting from a compression face 18 of the piston as well as a spring-loaded and therefore preadjustable nonreturn valve 20. The first valve slide and the nonreturn valve are disposed in bores (not shown), which form a flow path from working chamber 4 via the preadjustable nonreturn valve 20 and the valve slide 17 to the cylinder space 5.

In the region of its cylinder bottom 21, the second variant is also constructed differently from the first variant, in that a stop 22 in the form of a hollow cylinder is formed integrally with the cylinder bottom 21 in the second variant, and actually such that the push rod 19 of the first valve slide 17 can encounter an end face 23 of the stop.

The overpressure-limiting valve 12 in this case is disposed centrally with respect to the longitudinal axis 24 of the pneumatic cylinder, as indicated by a dot-dash line, wherein the flow passage 13 of the overpressure-limiting valve 12 extends into the interior of stop 22. In this construction there is achieved reliable contact of the compression face 18 of piston 16 against the end face 23 of the stop without tilting of the piston during simultaneous actuation of the push rod 19.

In the position of piston 16 shown in FIG. 3, which corresponds to an opened position of the smoke exhaust damper connected to the piston rod 3, the flow path via the preadjustable nonreturn valve 20 and the first valve slide 17 is closed, since the spring-loaded first valve slide seals the cylinder space 5 from the flow path. If, for example, compressed air is admitted to working chamber 5 via three/two-way valves, the piston 16, while compressing the air prefilled in cylinder space 5, in turn travels to the right toward the stop 23, in a manner corresponding to the initial pressure prevailing in the cylinder space 5 and the ratio of the areas of the compression face 18 and the working face (not shown) of piston 16, specifically until the compression face 18 of the piston 16 encounters the end face 23 of the stop 22, while at the same time the push rod 19 is thrust against the spring loading of the first valve slide 17 inward into the piston 16 and the valve slide 17 opens the flow path in the piston to the cylinder space 5. If, when piston 16 is in stopped position against stop 22, the end pressure (equal to the compression pressure) prevailing in the cylinder space 5 is still too low by a differential pressure that is adjusted at preadjustable nonreturn valve 20, the nonreturn valve opens until the differential pressure between working chamber 4 and cylinder space 5 reaches the preset value. Thus the same initial conditions for movement of the piston from the end position illustrated in FIG. 4 to the end position shown in FIG. 3 always exist. This movement of the piston for opening of the smoke exhaust damper also takes place in this case if the working chamber 4 is vented via connection bore 14 and the three/two-way valves (not illustrated). To reach this end pressure in the position of the piston 16 in the cylinder space 5 according to FIG. 4, it is not necessary that the pneumatic cylinder be in communication with an overturning damper which pulls the piston rod 3 beyond a specified opening position into the position corresponding to the completely opened position, but instead the pneumatic cylinder according to FIGS. 3 and 4 can be used without this restriction, while nevertheless ensuring a predetermined end pressure in cylinder space 5.

The function of the overpressure-limiting valve, which guarantees the end pressure even in the event of temperature changes, especially temperature rises of the surroundings, is the same as in the first variant according to FIGS. 1 and 2.

The third variant illustrated in FIGS. 5 and 6 differs from the second variant discussed hereinabove by the fact that the accumulator chamber in which the prefilled air is compressed by piston 16 is not formed completely by a cylinder space 25, but in addition a partial accumulator chamber is disposed as an annular chamber 26 around the cylinder 24. This annular chamber 26 is in communication with the cylinder space 25 via at least one bore 27 in a cylinder wall 28. The accumulator volume in this case is therefore greater by the volume of annular chamber 26 than the accumulator volume of the cylinder space 5 in the second variant according to FIGS. 3 and 4, assuming equal volumes of cylinder spaces 25 and 5. In other words, when the same total accumulator volume is to be achieved, the pneumatic cylinder 24 can be made shorter than the pneumatic cylinder 1 in FIGS. 3 and 4.

Figure 5:
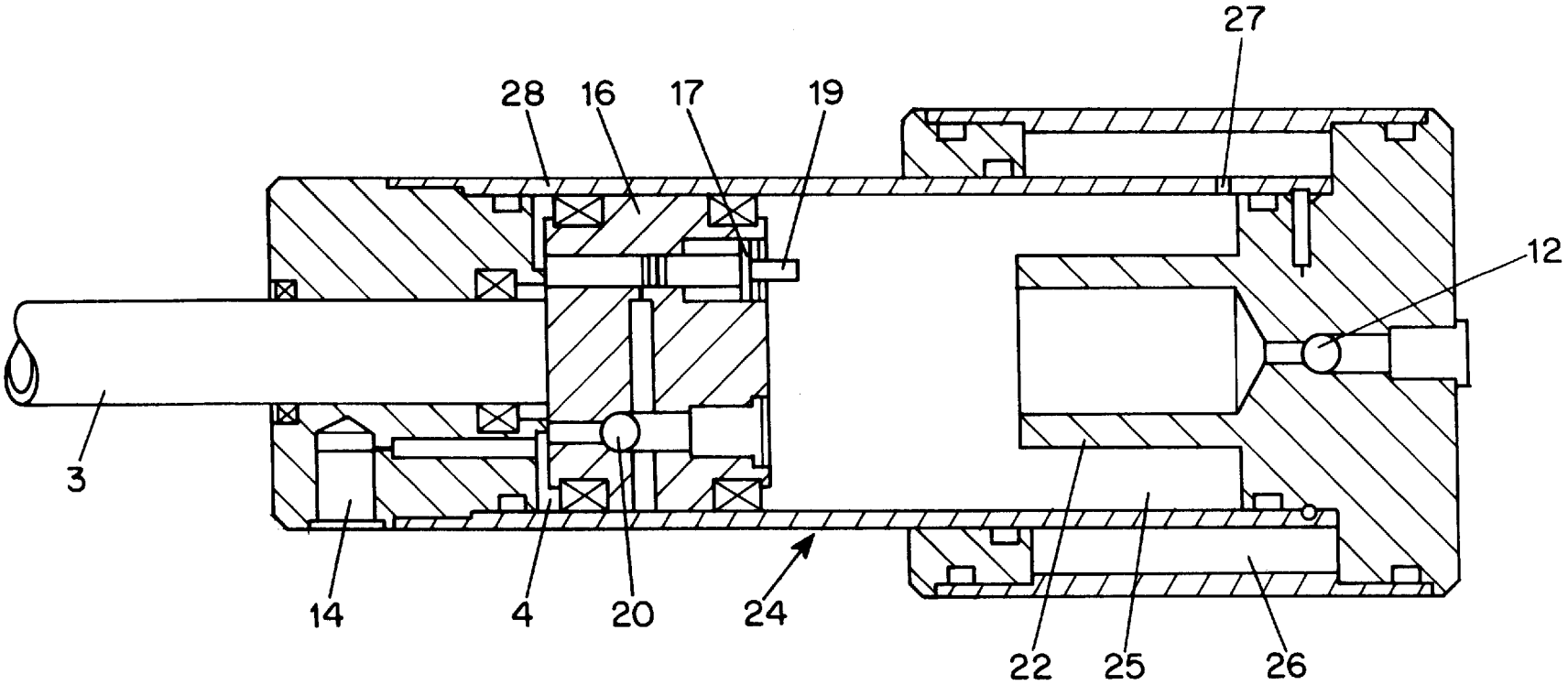
FIG. 5 shows a third variant, which is similar to the second variant, but with a partial accumulator chamber, which is disposed as an annular chamber around the cylinder, in a position which corresponds to the opened position of the smoke exhaust damper (not illustrated)
Figure 6:
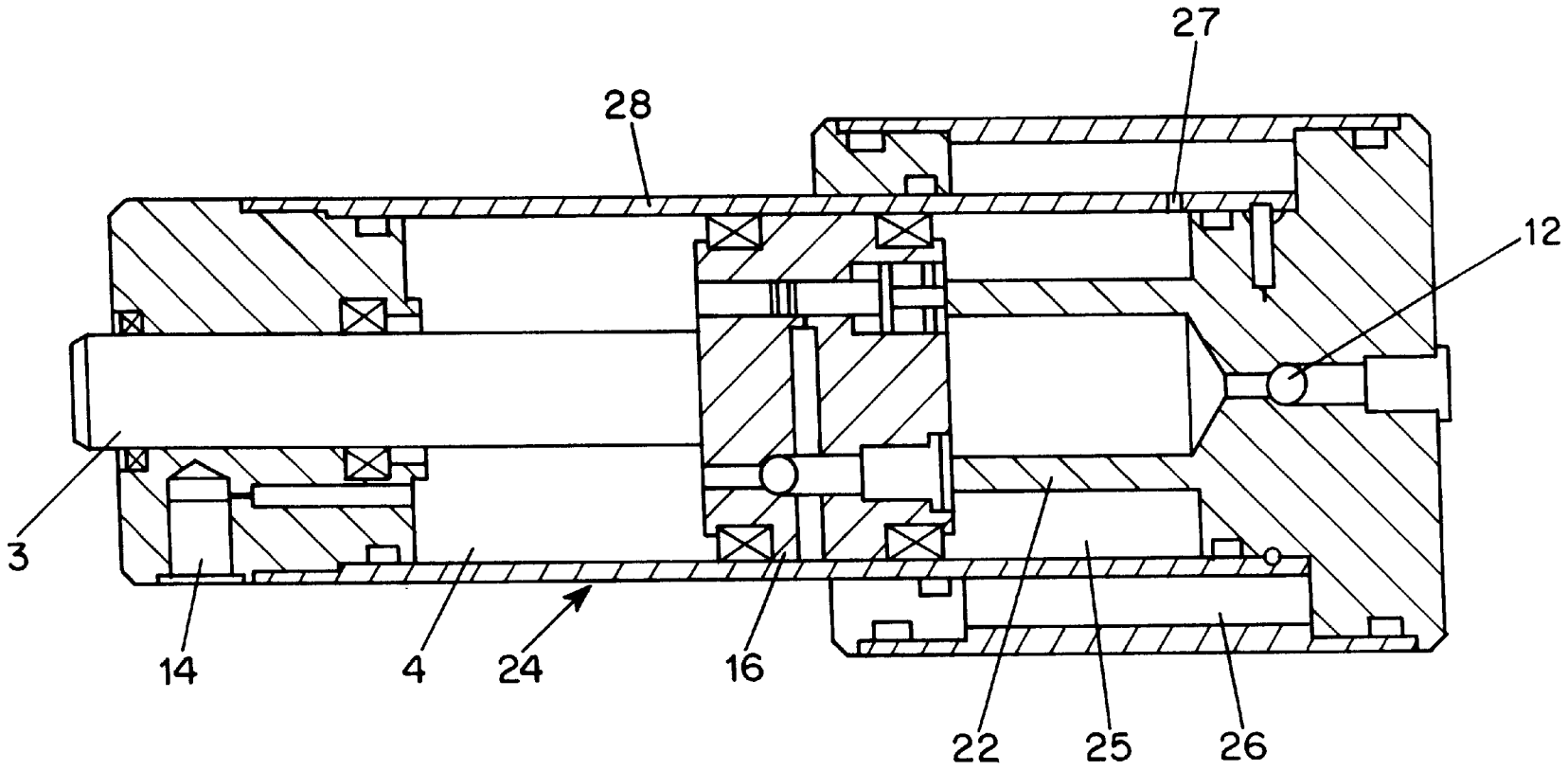
FIG. 6 shows the third variant according to FIG. 5, but in a position which corresponds to the closed position of the smoke exhaust damper.

Otherwise the functions of the third variant shown in FIGS. 5 and 6 are the same as discussed hereinabove, the position in FIG. 5 corresponding to the position in FIG. 3 of the second variant and the position in FIG. 6 corresponding to the position in FIG. 4 of the second variant.

Figure 7:
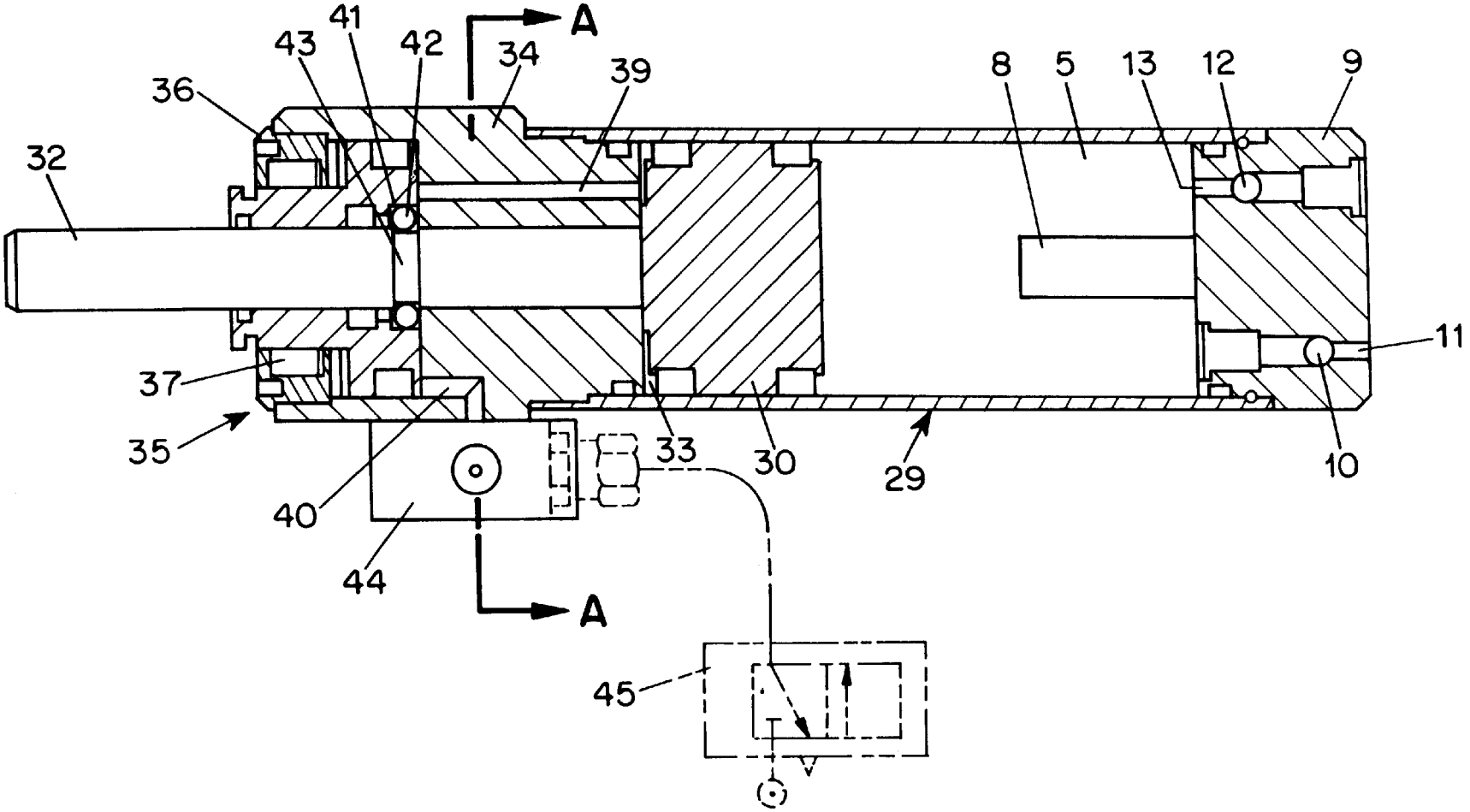
FIG. 7 shows a fourth variant, which is similar to the first variant, supplemented with a temperature valve as well as with a three/two-way valve that can be actuated in optional manner as well as with an end-position interlock, in an opened position of the smoke exhaust damper (not illustrated), connected to a piston rod.
Figure 8:
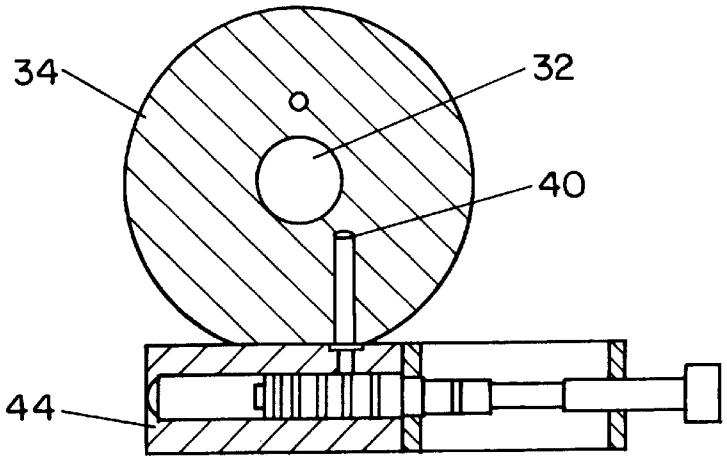
FIG. 8 shows a cross section through the fourth variant according to FIG. 7.
Figure 9:
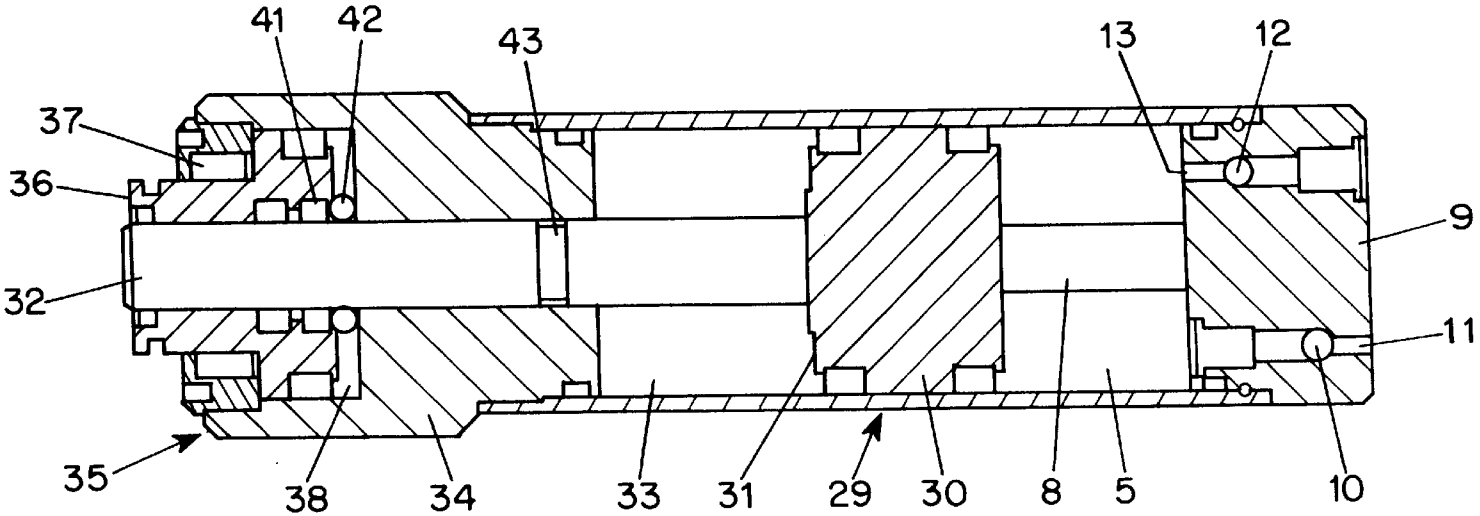
FIG. 9 shows the fourth variant in a position which corresponds to a closed position of the smoke exhaust damper, but without temperature valve and other three/two-way valve.

The fourth variant of the pneumatic cylinder 29 illustrated in FIGS. 7 to 9 corresponds, especially in the region of the cylinder space 5, to the first variant with the stop 8 in the cylinder space as well as the sealing cylinder bottom 9, in which there is disposed an underpressure valve 10 with a flow passage 11 as well as an overpressure-limiting valve 12 with a flow passage 13. In this respect, the functional description of the first variant can be used as reference.

According to the present fourth variant, a piston 30 is joined to a piston rod 32, which projects from a working face 31 of the piston. The working face 31 in turn bounds a working chamber 33, which at the other end is defined by a cylinder head 34.

In this case the cylinder head 34 accommodates in the outer region of its end face an end-position interlock represented as a whole by 35, which is suitable for interlocking the piston rod 32 in the position shown in FIG. 7, which corresponds to the opened position of a smoke exhaust damper (not illustrated) connected to the piston rod 32. For this purpose the end-position interlock comprises a latching piston 36, which tends to urge springs in the spring chamber 37 in the drawing to the right toward balls 42 as interlocking elements. In the inside of the cylinder head, the latching piston 36 bounds a latching pressure space 38, which is in pressure-conducting communication with the working chamber via a through bore 39 (not illustrated in FIG. 9). Via further bores 40—which also are not illustrated in FIG. 9—the latching pressure space and the working chamber can be supplied with the pressurizing fluid under working pressure or else vented via valves. Here also the preferred pressurizing fluid is compressed air.

On one inner end face, the latching piston 36 is further provided with a sleeve-like section 41, which is suitable for covering the balls 42 when the balls are disposed in an annular groove 43 in the piston rod, as shown in FIG. 7, or for releasing said balls, so that they are forced out of the annular groove 43 by displacement of the piston rod 32 and can be moved radially outward into the latching pressure space 38, as shown in FIG. 9.

Specifically, when the latching pressure space in FIG. 7 is vented, wherewith the working chamber 33 is also vented and the piston is urged leftward into the position which opens the smoke exhaust damper, the annular groove 43 will assume a position under the sleeve-like section 41 of the latching piston, which in this operating situation has been pushed to the right, whereby the balls 42 are held back in the annular groove 43 and immobilize the piston rod 32.

In contrast, in the operating situation according to FIG. 9, in which compressed air at working pressure has flowed into the latching pressure space 38 and the working chamber 33, the latching piston is pushed leftward against the spring force and the balls 42 can recoil radially outward and release the annular groove 43, whereby piston rod 42 is no longer immobilized and can be driven by the piston toward the right, which corresponds to the closed position of the smoke exhaust damper.

Control is provided as in variant 4 by a three/two-way temperature valve 44, which automatically vents the latching pressure space 38 and the working chamber 33 in the event of heating above a predetermined limit value. The temperature valve can be in communication with a further three/two way valve 45, which can be actuated as desired, for example manually or magnetically (as a solenoid valve). For this purpose, this three/two-way valve is in communication with a compressed-air source.

FIG. 8 shows a section through the temperature valve 44, which is of conventional design and so does not have to be described in detail. As also indicated in FIG. 7, this temperature valve is in communication with further bores 40 leading to the latching pressure space 38.

Figure 10:
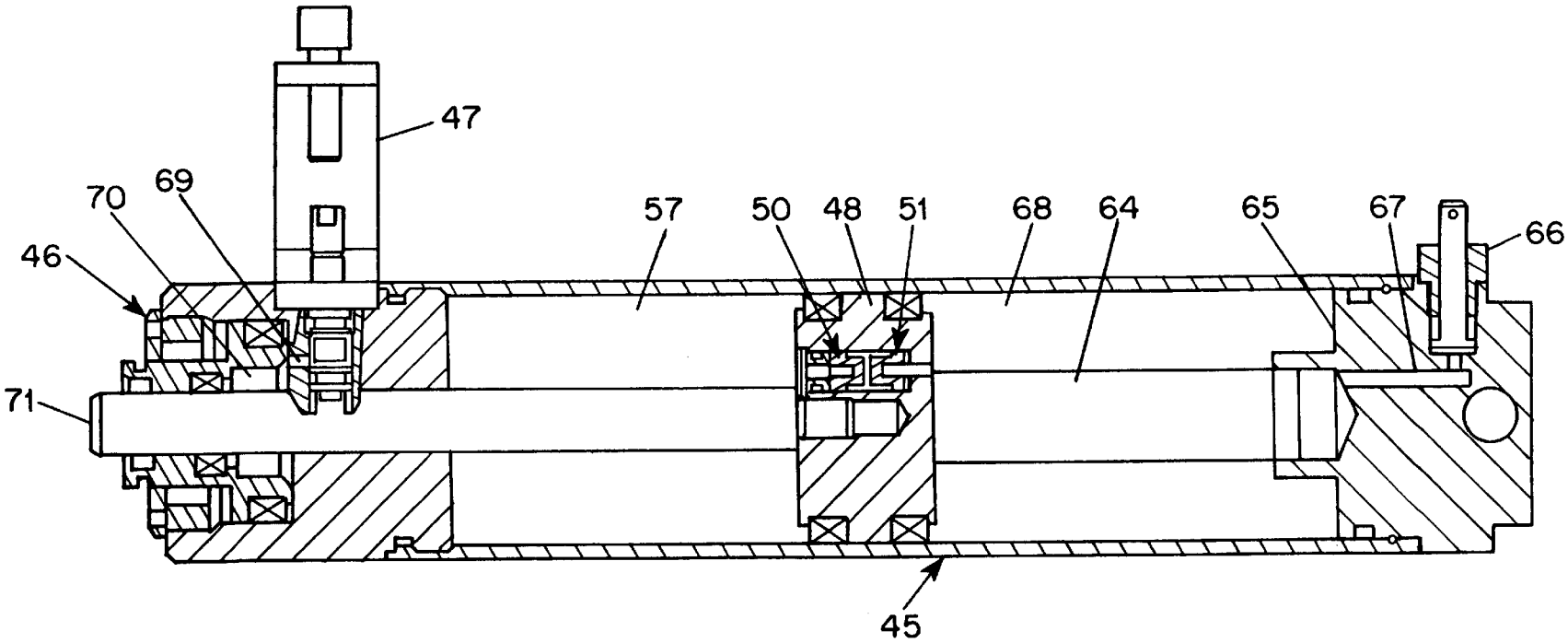
FIG. 10 shows a fifth variant in a position which corresponds to a closed position of the smoke exhaust damper, with a temperature valve as well as an end-position interlock of a smoke exhaust damper (not illustrated)
Figure 11:
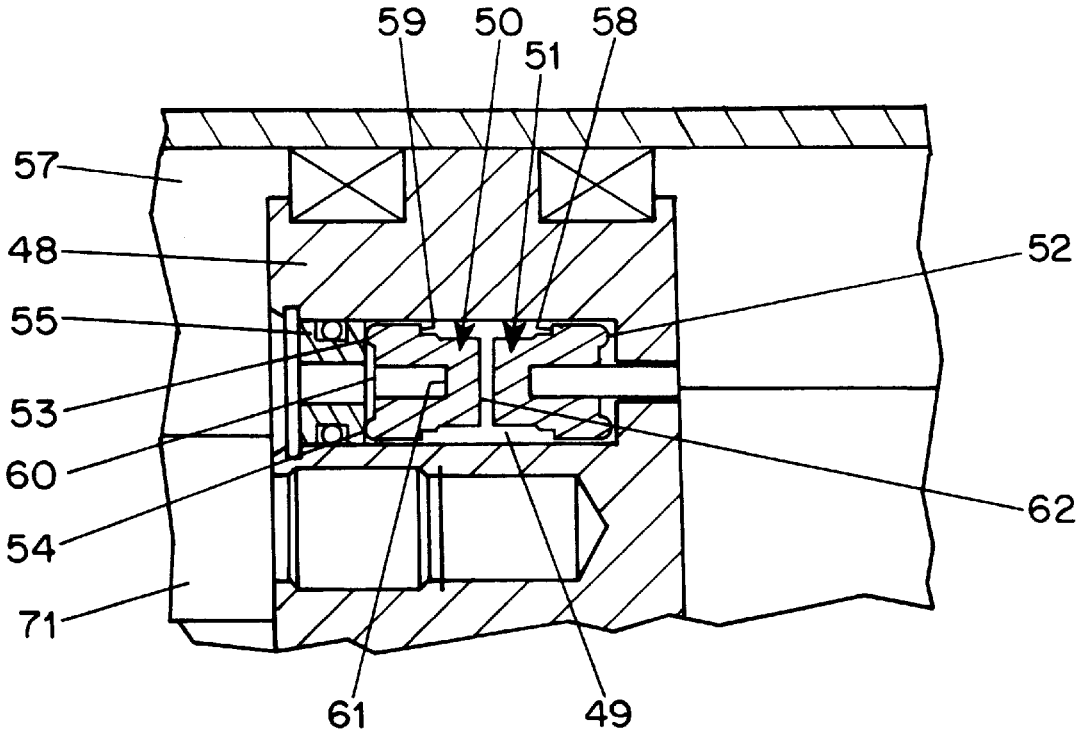
FIG. 11 shows a detail of the fifth variant, namely the piston in a position according to FIG. 10.
Figure 12:
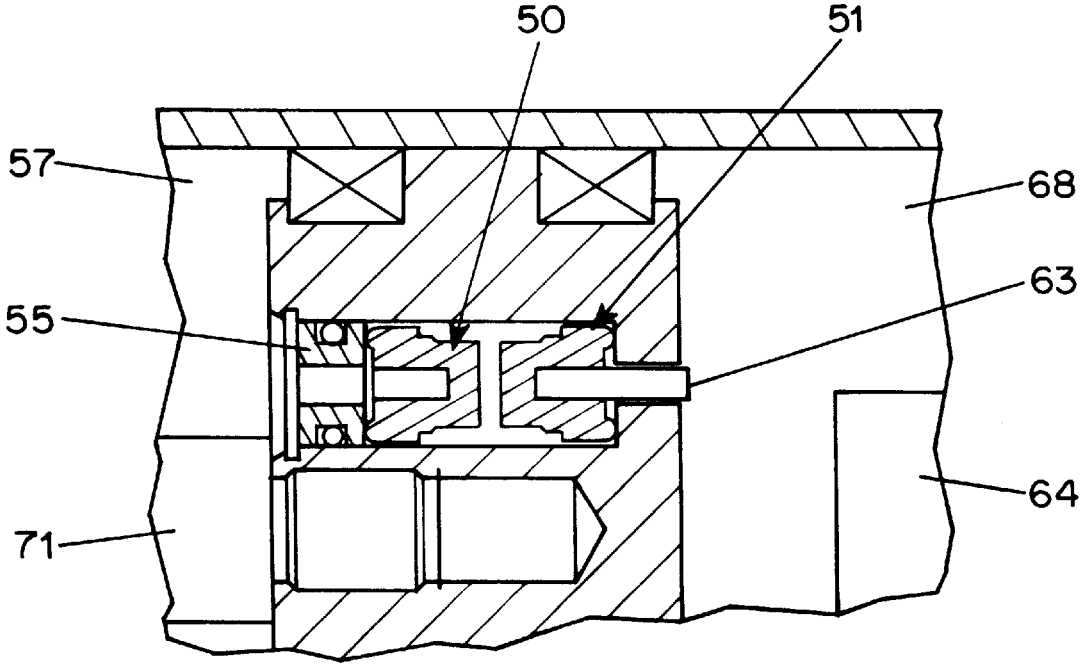
FIG. 12 shows the detail according to FIG. 11, but in an intermediate position between the positions which correspond to a closed or open position of the smoke exhaust damper.

In the preferred fifth variant of the pneumatic cylinder 45 shown in FIGS. 10 to 12, the left end section with end-position interlock 46 and temperature valve 47 corresponds to the fourth variant according to FIG. 7, and the region of piston 48 corresponds partly to the second variant according to FIG. 4. As a substantial difference from the second variant, however, a second valve slide 50, which constitutes the nonreturn valve 50, and a first valve slide 51 are disposed one after the other in a single bore 49 in axial direction of the piston 48. Both valve slides 50, 51 have the form of a rubber molding with an annular sealing bead 52 or 53 on the face end thereof. The sealing bead 52, 53 forms an effective seal in combination with a plane face against which it makes contact.

The second valve slide 50 in this case replaces the ball of the preadjustable nonreturn valve 20 in FIGS. 3 and 4. The sealing bead 53 of the second valve slide 50 acts sealingly under the spring force of a compression spring, which is not illustrated in the drawing but which, at each collar 58 or 59, braces the first or second valve slide 51 or 50 against an annular plane end face 54 of an insert 55 with through bore 56, which leads to a working chamber 57.

The first valve slide 51 is actuated by a push rod 63 when this encounters a stop 64 on a cylinder bottom 65.

The cylinder bottom 65 is provided with an overpressure-limiting valve 66, which is in communication via a bore 57 with a cylinder space 68 substantially separated from the working chamber 57. The first variant can again be considered as reference for the function thereof.

The end-position interlock 46 and the temperature valve 47, which are in communication via a bore with a latching pressure space 70, have been discussed in connection with the components of the fourth variant having the same effect. FIGS. 10 and 11 do not illustrate the balls 42 which in FIGS. 7 and 9 cooperate with a sleeve-like section 41. When compressed air under working pressure is admitted to the latching pressure space 70 and the working chamber 57 via a three-way valve connected to the temperature valve 47, the piston rod 71 is unlocked and the piston 48 is pressed against the stop 64 as illustrated in FIG. 10. Thereby the first valve slide 51 opens under the action of push rod 63, and a flow path via the first valve slide 51 and the second valve slide 50 acting as differential-pressure limiter in piston 48 is opened between the working chamber 57 and the cylinder space 68, until a differential pressure between the working chamber 57 and the cylinder space 68 reaches a value preset at the second valve slide 50.

When the working chamber 57 and the latching pressure chamber 70 are vented, the piston 48 is pushed leftward by the pressure prevailing in the cylinder space 68, thus opening the smoke exhaust damper connected to the piston rod 71, whereupon the second and the first valve slides 50, 51 act sealingly, as shown in FIG. 12. Otherwise the second valve slide 50 has the same function as the adjustable nonreturn valve 20 of the second variant.

Figure 13:
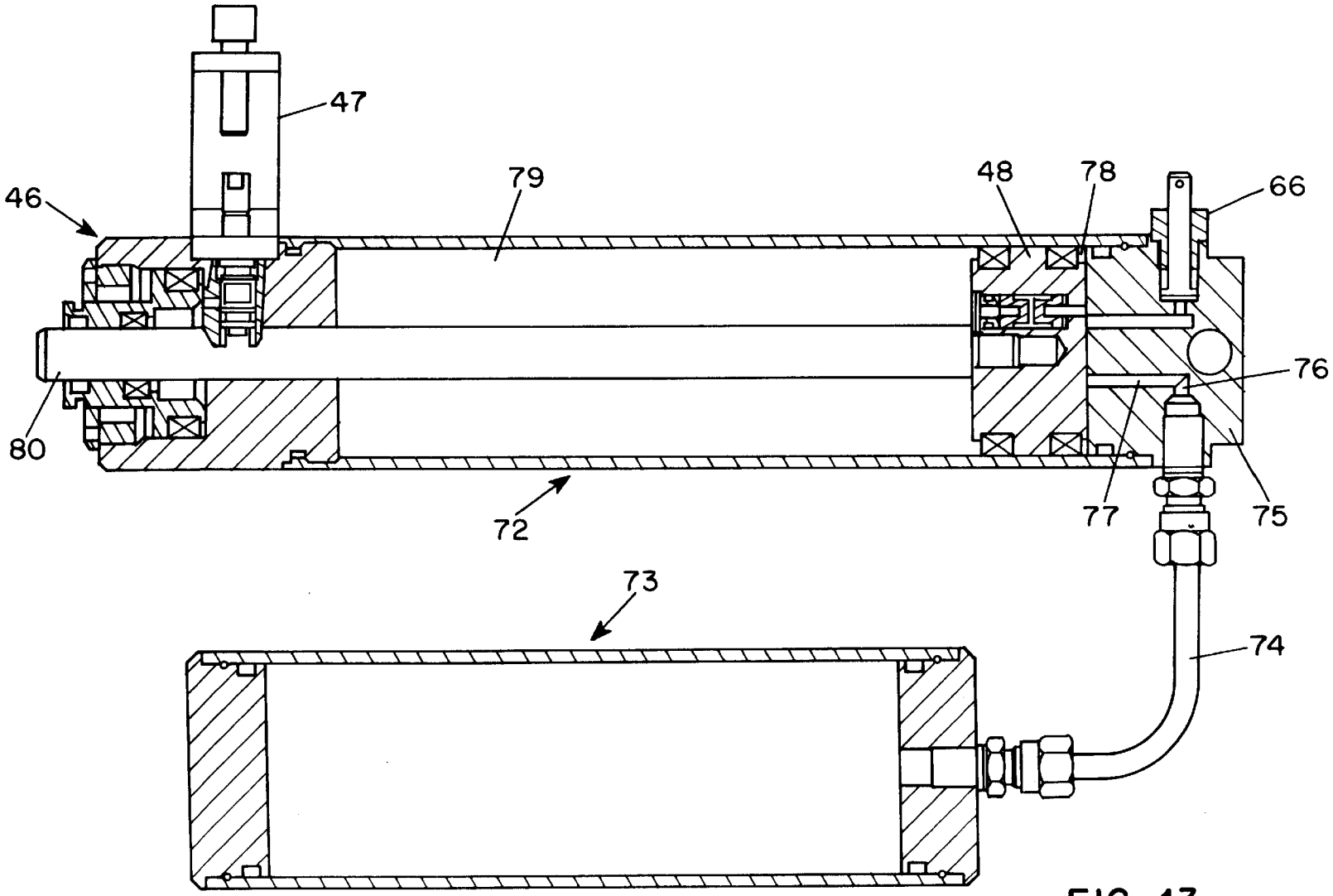
FIG. 13 shows a sixth variant similar to the fifth variant according to FIG. 10, but with a separate compressed-air accumulator.

The sixth variant of the pneumatic cylinder 72, shown in FIG. 13, differs from the fifth variant essentially by the fact that there is provided an external accumulator chamber 73, which is in communication with the cylinder bottom 75 via a line 74. Therein it is in communication via bores 76, 77 with a cylinder space 78, whose volume is reduced to practically zero in the shown position of the piston 48, because the piston 48 is pressed with one working face on a corresponding end face of the cylinder bottom 75, which lacks a stop projecting therefrom. The entire volume that cylinder 48 defines in cylinder 72 is therefore available as the working chamber 79, whereas the external accumulator chamber 73 can be installed in such a way that it is spatially separated from the pneumatic cylinder 72. The working stroke of the piston 48 and of the piston rod 89 are maximized.

I claim:

1. A pneumatic cylinder for actuating an adjustable element, especially a smoke exhaust damper in a smoke and heat exhaust system, with a piston (2, 16, 30, 48) to which pressure can be admitted on both sides, which has at least one working face (6, 31) and which can be displaced by compressed air in a cylinder (1, 24, 29, 45, 72) having at least one working chamber (4, 33, 57, 79), with a piston rod (3) which is connected to a smoke exhaust damper, and with an energy accumulator provided with positioning means, which admits pressure to the working face under control of a control device, wherein actuated and hold actuated, especially opened, the adjustable element, especially a smoke exhaust damper, characterized in that as the energy accumulator there is provided an accumulator chamber in which air or compressed air is stored as the compressible pressurizing fluid, and which is in pressure-conducting communication with a compression face (7, 18) of the piston (2, 16, 30, 48) on its face turned away from the working face (6, 31), and in that the control device actuates a vent valve in pressure-conducting communication with the working chamber (4, 33, 57, 79).

2. A pneumatic cylinder according to claim 1, characterized in that the accumulator chamber is formed completely by a substantially closed cylinder space (5), which in the cylinder (1, 29, 45) is partitioned off from the working chamber (4, 33) by the piston (2, 16, 32, 48).

3. A pneumatic cylinder according to claim 1, characterized in that the accumulator chamber is formed partly if need be by the cylinder space (25), which in the cylinder (24, 72) is partitioned off from the working chamber (4) by the piston (16, 48), and in that a partial accumulator chamber is in communication with this cylinder space (25) via a flow path (bore 27).

4. A pneumatic cylinder according to claim 3, characterized in that an annular chamber (26) is disposed around the cylinder (24) to obtain the partial accumulator chamber.

5. A pneumatic cylinder according to claim 1, characterized in that a stop (8, 22, 64) is provided to limit the movement capability of the piston in the cylinder space (5, 25, 68) which is partitioned off from the working chamber.

6. A pneumatic cylinder according to claim 5, characterized in that the stop (8, 22, 64) is disposed on the cylinder space (5, 25, 68) partitioned off from the working chamber (4).

7. A pneumatic cylinder according to claim 1, characterized in that the working chamber (4, 57) and the cylinder space (5, 25, 68) partitioned off therefrom are in communication via a flow path in which there is disposed a differential-pressure limiter automatically controlled by mechanical means.

8. A pneumatic cylinder according to claim 7, characterized in that in the piston (16, 48) there are disposed a first valve slide (17, 51), which can be actuated by the stop in the cylinder space, as well as a nonreturn valve (20), which acts as a differential-pressure limiter in such a way that a flow path between the cylinder space and the working chamber is opened in the piston (16, 48) when the valve slide encounters the stop and a differential pressure between the working chamber and the cylinder space reaches a value preset on the nonreturn valve.

9. A pneumatic cylinder according to claim 8, characterized in that the nonreturn valve is constructed as a second valve slide (50) and in that the second valve slide (50) as well as the first valve slide (51), together with a push rod (63) extending therefrom, are mounted coaxially one after the other in a common bore (49) in the piston (48), in one end of which there is positioned an insert (55), and in that the first valve slide (51) and the second valve slide (50) are thrust outward toward sealing surfaces (54) by a compression spring disposed between them.

10. A pneumatic cylinder according to claim 9, characterized in that the first valve slide (51) and the second valve slide (50) have the form of rubber moldings with sealing bead (52, 53) formed annularly on their external end face.

11. A pneumatic cylinder, which in particular is connected to a smoke exhaust damper in such a way that, during opening thereof beyond a constructively predetermined opening angle, the piston of the pneumatic cylinder is moved by the smoke exhaust damper toward the working chamber, according to claim 1, characterized in that the pressurizing-fluid refilling device is designed as a pressurizing-fluid suck-back device in the form of an overpressure valve (10), preferably in a cylinder bottom (9) or cylinder wall, via which valve the cylinder space (5) partitioned off from the working chamber (4) is in communication with the outside atmosphere.

12. A pneumatic cylinder according to claim 1, characterized in that the cylinder space (5, 25, 68, 78) partitioned off from the working chamber (4) is in communication with the outside atmosphere via an overpressure-limiting valve (12, 66), which is preferably disposed in a cylinder bottom (9, 65, 75) or a cylinder wall.

13. A pneumatic cylinder according to claim 1, characterized in that a piston rod (32, 64, 80) with at least one end-position interlock (35) can be interlocked in the position to which it is retracted by the pressure in the accumulator chamber when the working chamber (33, 57, 79) is vented.

14. A pneumatic cylinder according to claim 13, characterized by an end-position interlock for the piston rod at both ends.

15. A pneumatic cylinder according to claim 1, characterized in that the accumulator chamber is prefilled with air.

* * * * *